US006561173B2

(12) United States Patent
Betz et al.

(10) Patent No.: US 6,561,173 B2
(45) Date of Patent: May 13, 2003

(54) IGNITION SYSTEM FOR INTERNAL COMBUSTION ENGINES

(75) Inventors: Dieter Betz, Vaihingen (DE); Wolfram Schoellig, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 63 days.

(21) Appl. No.: 09/821,497

(22) Filed: Mar. 29, 2001

(65) Prior Publication Data

US 2001/0047803 A1 Dec. 6, 2001

(30) Foreign Application Priority Data

Mar. 29, 2000 (DE) ..... 200 05 821 U

(51) Int. Cl.[7] ..... F02P 1/00
(52) U.S. Cl. ..... 123/634; 336/96
(58) Field of Search ..... 123/634, 635; 336/90, 92, 96

(56) References Cited

U.S. PATENT DOCUMENTS 5,706,792 A * 1/1998 Boyer et al. ..... 123/169 PA
6,215,385 B1 * 4/2001 Ogden ..... 123/634
6,332,458 B1 * 12/2001 Shimada et al. ..... 123/634
6,337,616 B1 * 1/2002 Sato et al. ..... 336/234
6,353,378 B1 * 3/2002 Oosuka et al. ..... 336/110
6,437,674 B1 * 8/2002 Hamer et al. ..... 29/602.1
6,456,181 B2 * 9/2002 Nakamura ..... 336/90

FOREIGN PATENT DOCUMENTS

DE 41 32 851 4/1992

* cited by examiner

*Primary Examiner*—John Kwon
(74) *Attorney, Agent, or Firm*—Kenyon & Kenyon

(57) ABSTRACT

An ignition system for an internal combustion engine is designed so that it can be inexpensively produced in a manner advantageous from a standpoint of production engineering. The ignition system includes a shaft in a cylinder head of an internal combustion engine and a coil rod, which can be inserted over a portion of its longitudinal extension into the shaft. The coil rod forms an open magnetic circuit which is controlled by a tubular, longitudinally slit return plate. This return plate is set apart from the coil rod, in the shaft of the cylinder head. The ignition system is intended to be used in the automobile industry.

4 Claims, 1 Drawing Sheet

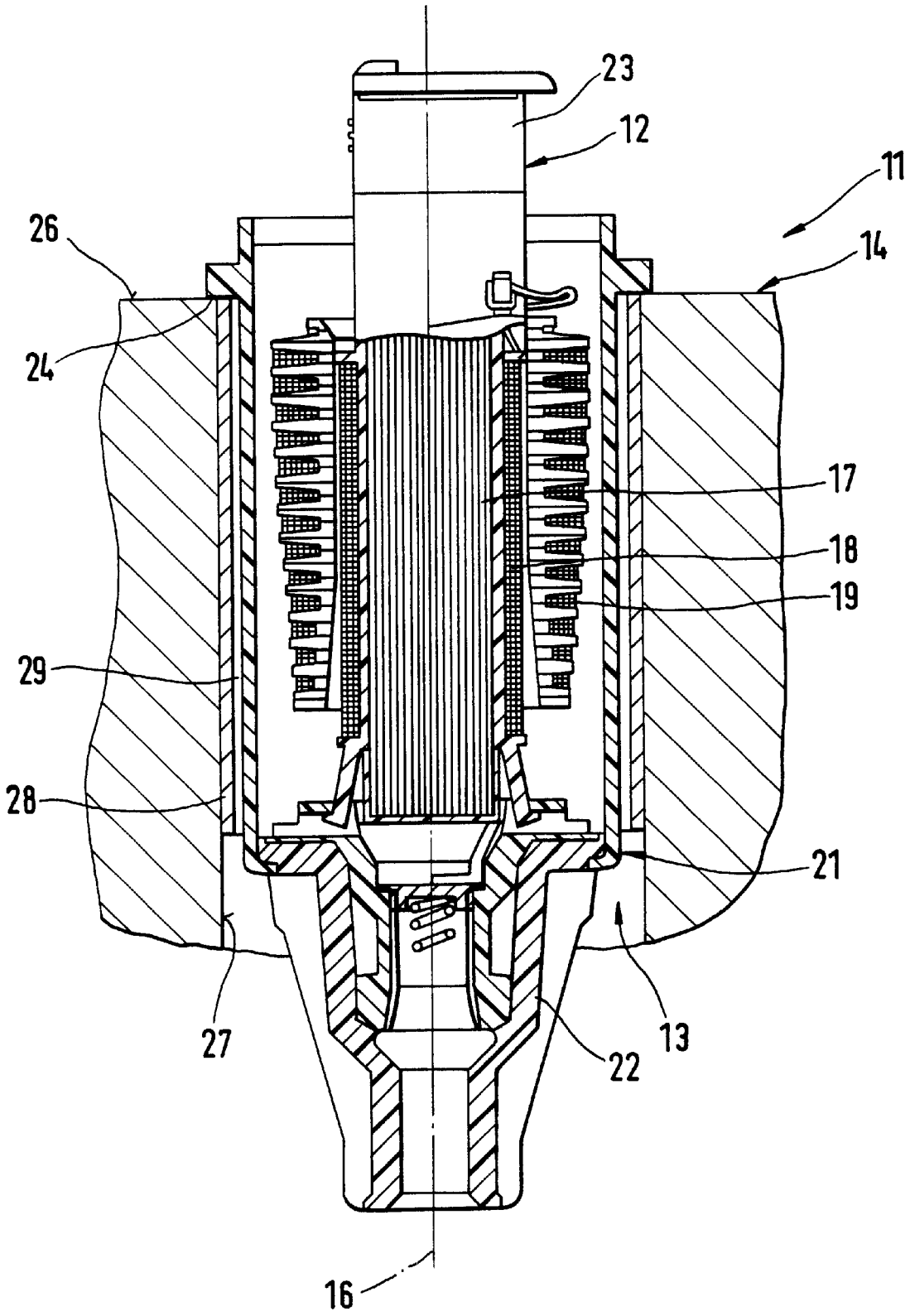
23
12
11
26
14
24
17
18
19
29
28
21
27
13
22
16

IGNITION SYSTEM FOR INTERNAL COMBUSTION ENGINES

FIELD OF THE INVENTION

The present invention relates to an ignition system for internal combustion engines. The ignition system includes a coil rod and a shaft in a cylinder head of the internal combustion engine, into which shaft the coil rod is inserted over a portion of its longitudinal extension.

BACKGROUND INFORMATION

German Patent No. 41 32 851 describes a coil rod that can be inserted into the shaft of a cylinder head of an internal combustion engine in a customary, not further represented manner.

The coil rod has a housing whose basic form is cylindrical. In the housing, a bar-shaped core is situated in a central position as the internal part of an open magnetic circuit. A primary winding and a secondary winding are disposed in a concentric manner around the core, each on a separate coil form. A tubular outer iron core in the form of a longitudinally slit return plate is situated around the secondary winding.

The exterior, peripheral surface of the return plate made of ferromagnetic material abuts on the inner surface of the plastic housing. Due to the extremely different thermal expansion properties between the ferromagnetic material and the plastic, a sturdy bearing arrangement of the return plate on the housing requires in an undesirable manner a high production expenditure, thereby rendering it more expensive to produce the ignition system.

SUMMARY OF THE INVENTION

In comparison with the related art, the ignition system for internal combustion engines according to the present invention has the advantage that the previously mentioned shortcomings are avoided. As such, the ignition system is designed in such a manner that the return plate of the open magnetic circuit is no longer attached within the coil rod, but supported in the shaft of the internal combustion engine, set apart from the coil rod.

As a result, on the one hand, the coil rod can be manufactured in a manner that is favorable from a standpoint of production engineering, without the critical connection of the housing to the return plate.

On the other hand, the bearing arrangement of the return plate in the shaft of the metallic cylinder head is unproblematic, since, in this instance, only minimal, non-critical differences in the thermal expansion properties occur between the two metals.

In addition, the return plate being highly prestressed in a self-holding manner can be inserted into the shaft, since the solid cylinder head can also absorb large compressive forces without the danger of gradually yielding to form cracks.

As such, also in this instance, a path favorable from a standpoint of production engineering is followed, thereby resulting in low production costs for the ignition system.

BRIEF DESCRIPTION OF THE DRAWING

The FIGURE shows a lateral, partially sectional view of the ignition system.

DETAILED DESCRIPTION

An ignition system 11 for internal combustion engines according to the FIGURE has a coil rod 12 and a shaft 13 in a cylinder head 14 of the internal combustion engine.

The coil rod includes an oblong, cylindrical internal core 17, also called the I-core, situated in a coaxial manner with respect to longitudinal axis 16. Core 17 is made of a layered, magnetic material and is part of an open magnetic circuit.

Situated concentrically around core 17 is an internal, low-voltage conducting primary winding 18 and an external, high-voltage conducting secondary winding 19. Windings 18,19 are enclosed by cup-shaped, plastic housing 21, and spaces in coil rod 12 are filled in an electrically insulating manner with a hardening cast resin.

A high-voltage terminal 22 of coil rod 12 is formed at one end of housing 21 to connect to a spark plug. A low-voltage terminal 23, via which coil rod 12 is connected to a control unit, is attached at the opposite end of housing 21.

With minimal radial joining play, coil rod 12 is inserted over a large portion of its longitudinal extension, up to where a shoulder 24 of housing 21 rests on an upper face 26 of cylinder head 14. In this context, in a manner not further shown, high-voltage terminal 22 contacts a stationary spark plug mounted in shaft 13.

A longitudinally slit return plate 28 is placed under prestress on an inner wall 27 of shaft 13 in such a manner that it concentrically surrounds core 17 and windings 18, 19 with at least an equal longitudinal extension.

Return plate 28 is made of ferromagnetic material and forms the return element of the open magnetic circuit of coil rod 12. In this context, return plate 28 is used to control (conduct) the magnetic circuit and is also called the outer core.

A small gap 29, which enables coil rod 12 to move when being inserted into shaft 13, remains between return plate 28 and housing 21.

In response to temperature fluctuations at ignition system 11, as can occur during operation of the internal combustion engine and coil rod 12, in particular, the connection of metallic return plate 28 to inner wall 27 of the metallic cylinder head remains sturdy because the differences in the thermal expansion properties between return plate 28, on the one hand, and cylinder head 14, on the other hand, is not critical.

In addition, as a solid structural element, cylinder head 14 is so sturdy that it can absorb the prestress force of return plate 28 while remaining stable long-term and without changing the structure of its material.

As such, introducing return plate 28 into shaft 13 is simple to carry out from a standpoint of production engineering, which leads to low production costs for ignition system 11, which can also be attributed to return plate 28 being directly connected via cylinder head 14 to an electrical zero potential, and a separate line to a ground contact not being necessary.

Also when replacing coil rod 12, only a simply constructed, inexpensive coil rod 12 without a return plate 28 is necessary since return plate 28 is permanently anchored in shaft 13.

What is claimed is:

1. An ignition system for an internal combustion engine, the internal combustion engine including a cylinder head, the ignition system comprising:

a shaft situated in the cylinder head of the engine;

a coil rod capable of being inserted into the shaft over at least a portion of a longitudinal extension of the coil rod, the coil rod forming an open magnetic circuit during operation;

an inner core composed of a ferromagnetic material; and a tubular, longitudinally slit return plate acting as an exterior iron core, the return plate of the open magnetic circuit being set apart from the coil and being supported in the shaft of the cylinder head.

2. The ignition system according to claim 1, wherein the inner core is centrally situated in the coil rod.

3. The ignition system according to claim 1, wherein, when the coil rod is inserted into the shaft, the return plate is situated concentrically with respect to the inner core and has at least a longitudinal extension of the inner core.

4. The ignition system according to claim 3, wherein the return plate is supported in the shaft in a prestressed, elastically expanding manner.

* * * * *